US007852178B2

(12) United States Patent
Bush et al.

(10) Patent No.: US 7,852,178 B2
(45) Date of Patent: Dec. 14, 2010

(54) HERMETICALLY SEALED ELECTROMECHANICAL RELAY

(75) Inventors: Bernard Victor Bush, Santa Barbara, CA (US); Marcus Priest, Carpinteria, CA (US)

(73) Assignee: Tyco Electronics Corporation, Middletown, PA (US)

( * ) Notice: Subject to any disclaimer, the term of this patent is extended or adjusted under 35 U.S.C. 154(b) by 81 days.

(21) Appl. No.: 11/604,928

(22) Filed: Nov. 28, 2006

(65) Prior Publication Data

US 2008/0122562 A1 May 29, 2008

(51) Int. Cl.
*H01H 67/02* (2006.01)

(52) U.S. Cl. ..... 335/126; 335/131

(58) Field of Classification Search ..... 335/126, 335/131

See application file for complete search history.

(56) References Cited

U.S. PATENT DOCUMENTS

| | | | | | |
|---|---|---|---|---|---|
| 2,339,676 | A * | 1/1944 | Bucklen, Jr. | ..... | 218/146 |
| 2,908,780 | A * | 10/1959 | Walters, Jr. | ..... | 335/154 |
| 2,912,543 | A * | 11/1959 | Hawkins | ..... | 335/122 |
| 2,920,162 | A * | 1/1960 | Steward et al. | ..... | 335/126 |
| 3,091,725 | A * | 5/1963 | Huston | ..... | 335/230 |
| 3,571,770 | A * | 3/1971 | Dew | ..... | 335/256 |
| 5,015,980 | A * | 5/1991 | Sugiyama | ..... | 335/126 |
| 5,394,128 | A * | 2/1995 | Perreira et al. | ..... | 335/126 |
| 5,424,700 | A * | 6/1995 | Santarelli | ..... | 335/126 |
| 5,519,370 | A * | 5/1996 | Perreira et al. | ..... | 335/154 |
| 5,554,963 | A | 9/1996 | Johler et al. | | |
| 5,663,699 | A * | 9/1997 | Shiroyama | ..... | 335/126 |
| 5,679,935 | A * | 10/1997 | Baba et al. | ..... | 200/17 R |
| 5,903,203 | A * | 5/1999 | Elenbaas | ..... | 335/179 |
| 5,909,067 | A * | 6/1999 | Liadakis | ..... | 310/14 |
| 6,265,955 | B1 | 7/2001 | Molyneux et al. | | |
| 6,911,884 | B2 * | 6/2005 | Uotome et al. | ..... | 335/132 |
| 7,157,996 | B2 * | 1/2007 | Enomoto et al. | ..... | 335/132 |
| 2006/0050466 | A1 * | 3/2006 | Enomoto et al. | ..... | 361/160 |
| 2006/0261916 | A1 * | 11/2006 | Molyneux et al. | ..... | 335/128 |

* cited by examiner

*Primary Examiner*—Elvin G Enad
*Assistant Examiner*—Alexander Talpalatskiy

(57) ABSTRACT

An electromechanical relay includes an armature and an inner core at least partially surrounding at least a portion of the armature. The armature is slidably movable relative to the inner core. A coil at least partially surrounding at least a portion of the inner core. The relay also includes a stationary contact held in a ceramic header and a movable contact connected to the armature via a shaft. The movable contact is movable between an open position wherein the movable contact does not engage the stationary contact and a closed position wherein the movable contact engages the stationary contact. The relay also includes a housing having an open end and a chamber. The chamber contains the armature, the inner core, the coil, the movable contact, and at least a portion of the stationary contact. The housing forms a portion of a magnetic circuit of the relay. The ceramic header is circumferentially welded to the housing adjacent the open end such that the chamber of the housing is hermetically sealed.

11 Claims, 4 Drawing Sheets

HERMETICALLY SEALED ELECTROMECHANICAL RELAY

BACKGROUND OF THE INVENTION

The invention relates generally to electromechanical relays and, more particularly, to hermetically sealed electromechanical relays.

Hermetically sealed electromagnetic relays are sometimes used in explosive environments and/or for switching relatively high electrical currents and/or voltages. Hermetically sealed relays typically have stationary and movable contacts, and an actuating mechanism supported within a hermetically sealed chamber. High voltage, high current relays may suffer from contact welding and short circuiting of the relay terminals through vapor deposition of metal across the relay housing. These problems are caused by arcing between the moving contact and the stationary contacts, for example during hot switching operations. To suppress arcing, the relay chamber is evacuated and sealed so that the fixed and movable contacts coact in a complete or partial vacuum environment. Alternatively, the evacuated chamber is backfilled with an inert and/or insulating gas having good arc-suppressing properties. Further arc suppression may be achieved by imposing magnetic fields in the contact area. These magnetic fields cause a force on the arc column perpendicular to the current flow, which pushes the arc away from a source of plasma (hot arc spots) and stretches a length of the arc, thereby increasing the resistance to facilitate extinguishing the arc.

To hermetically seal the relay chamber, some known relays include an epoxy potting compound sealing an interface between the relay housing and a plastic holder that holds the stationary contacts. However, the epoxy potting compound may have a lower temperature rating than desired for some relay applications, which may compromise the hermetic seal above some temperatures. Moreover, some epoxy potting compounds may be porous to some gases, for example hydrogen, which may compromise the ability of the epoxy potting compound to hold a complete vacuum and/or contain some inert and/or insulating gases.

What is needed therefore is a hermetically sealed relay that contains a higher vacuum, has a seal that is less porous to some inert and/or insulating gases, and/or is able to maintain such a seal at higher temperatures than known hermetically sealed relays.

BRIEF DESCRIPTION OF THE INVENTION

In one aspect, an electromechanical relay includes an armature and an inner core at least partially surrounding at least a portion of the armature. The armature is slidably movable relative to the inner core. A coil at least partially surrounds at least a portion of the inner core. The relay also includes a stationary contact held in a ceramic header and a movable contact connected to the armature via a shaft. The movable contact is movable between an open position wherein the movable contact does not engage the stationary contact and a closed position wherein the movable contact engages the stationary contact. The relay also includes a housing having an open end and a chamber. The chamber contains the armature, the inner core, the coil, the movable contact, and at least a portion of the stationary contact. The housing forms a portion of a magnetic circuit of the relay. The ceramic header is circumferentially welded to the housing adjacent the open end such that the chamber of the housing is hermetically sealed.

In another aspect, an electromechanical relay includes an armature and an inner core at least partially surrounding at least a portion of the armature. The armature is slidably movable relative to the inner core. The relay also includes a coil at least partially surrounding at least a portion of the inner core, a stationary contact, and a movable contact connected to the armature via a shaft. The movable contact is movable between an open position wherein the movable contact does not engage the stationary contact and a closed position wherein the movable contact engages the stationary contact. The relay also includes a housing having a chamber. The chamber contains the armature, the inner core, the coil, the movable contact, and at least a portion of the stationary contact. The relay also includes a permanent magnet held within the chamber of the housing. The movable contact is magnetically latchable in the open and closed positions by the permanent magnet. The movable contact is unlatched from the open and closed positions and latched in the open and closed positions by application of power to the coil.

In another aspect, an electromechanical relay includes an armature and an inner core at least partially surrounding at least a portion of the armature. The armature is slidably movable relative to the inner core. The relay also includes a coil at least partially surrounding at least a portion of the inner core, a stationary contact, and a movable contact connected to the armature via a shaft. The movable contact is movable between an open position wherein the movable contact does not engage the stationary contact and a closed position wherein the movable contact engages the stationary contact. The movable contact is biased to the closed position by a permanent magnet acting on the armature. The movable contact is movable to the open position by application of power to the coil. The relay also includes a housing having a chamber, the chamber containing the armature, the inner core, the coil, the movable contact, and at least a portion of the stationary contact.

DETAILED DESCRIPTION OF THE INVENTION

Figure 1:
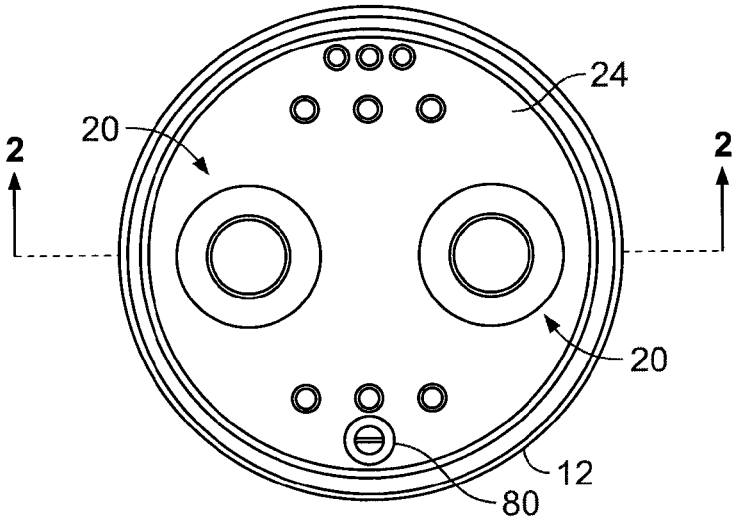
FIG. 1 is a plan view of an electromechanical relay formed in accordance with an embodiment of the present invention.
Figure 2:
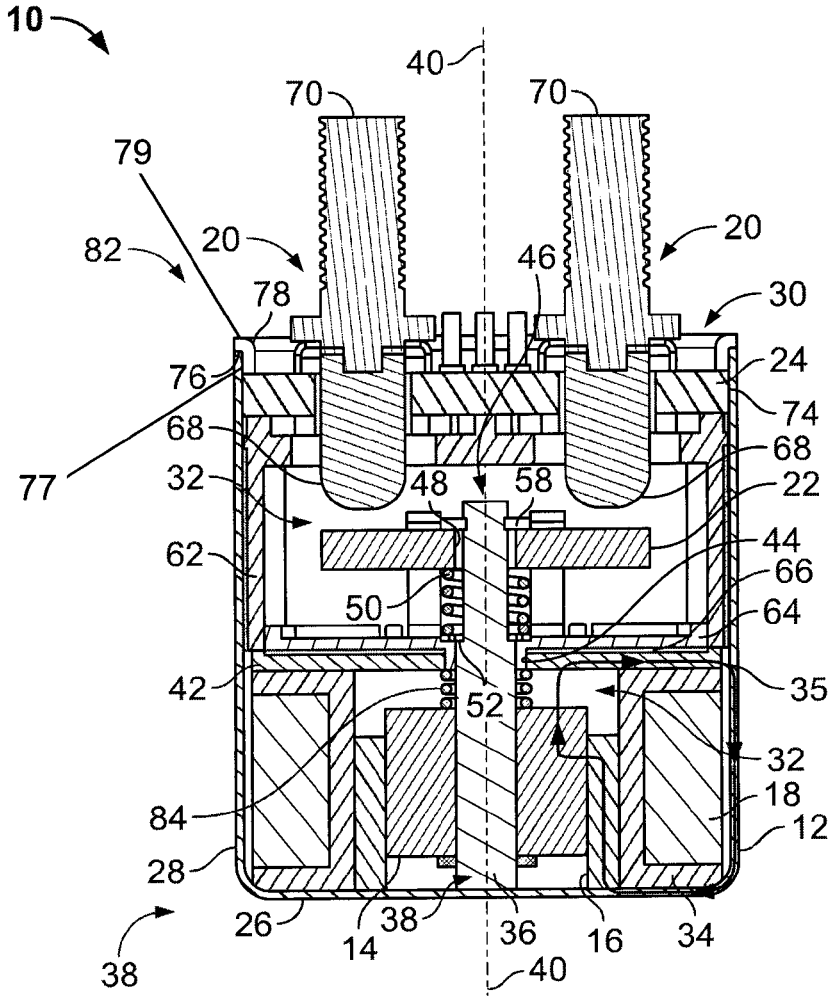
FIG. 2 is a cross-sectional view of the relay shown in FIG. 1 in an open position.

Referring now to FIGS. 1 and 2, an electromechanical relay 10 formed in accordance with an embodiment of the present invention generally includes a housing 12, an armature 14, an inner core 16, a coil 18, a pair of stationary contact assemblies 20, one or more movable contacts 22, and a ceramic header 24. The housing 12 includes a bottom wall 26, a side wall 28 extending from the bottom wall 26, and an open end 30. The side and bottom walls 28, 26, respectively, define a chamber 32 extending between the bottom wall 26 and the open end 30. The coil 18 is wound on a bobbin 34 held within the chamber 32 adjacent the bottom wall 26 of the housing 12. The coil 18 surrounds the inner core 16, which is fabricated from a ferromagnetic material and is also held within the chamber 32 adjacent the bottom wall 26 of the housing 12. The relay 10 may optionally include an internal coil control circuit (not shown) configured to regulate power dissipated by the coil 18 when energized.

The inner core 16 acts as a part of the primary magnetic circuit 35 for directing the magnetic flux generated by the coil 18. The inner core 16 surrounds the armature 14, which is fabricated from a ferromagnetic material and is connected to a shaft, or insulated rod, 36 adjacent an end 38 of the insulated rod 36. The insulated rod 36 is fabricated from a non-ferromagnetic material and/or non-metallic insulating material, such as, but not limited to, glass-filled nylon. The armature 14 is connected to the insulated rod 36 for movement therewith and is slidably movable relative to the inner core 16 via movement of the insulated rod 36 along a longitudinal axis 40 of the relay 10. The coil 18, the inner core 16, and the armature 14 are sandwiched between the bottom wall 26 of the housing and a top core 42 held within the chamber 32. The top core 42 is fabricated from a ferromagnetic material and includes an opening 44. A portion of the insulated rod 36 extends through the opening 44. The opening 44 and the insulated rod 36 are sized to allow movement of the insulated rod 36 through the opening 44 and relative to the top core 42. Optionally, a bearing (not shown) and/or bushing (not shown) may be provided between the insulated rod 36 and the top core 42 to reduce friction and thereby facilitate movement of the insulated rod 36 through the opening 44.

The housing 12 may optionally form a portion of the primary magnetic circuit 35 of the relay 10. Specifically, the coil 18, the inner core 16, the armature 14, and the top core 42 form a portion of a magnetic circuit. The housing 12 may optionally be fabricated from a ferromagnetic material and the top core 42 may be positioned within the chamber 26 in close proximity with the side wall 28 of the housing 12 such that the housing 12 forms a magnetic return from the top core 42 to the coil 18. The housing 12 may thus form an outer core surrounding the coil 18. The housing 12 may be fabricated from any suitable ferromagnetic material that enables the housing 12 to function as described herein, such as, but not limited to, C1008 iron based alloy. The relay 10 may include an outer housing (not shown) fabricated from one or more suitable non-electrically conductive and/or dielectric materials, such as, but not limited to a glass filled nylon material and/or other polymers such as, but not limited to, polyamide, polyester, polyethylene terephthalate (PET), and/or polyolefin, for example to prevent a person or object from becoming a portion of the magnetic circuit of the relay 10 by contacting the housing 12. Alternatively, the housing 12 is not fabricated from a ferromagnetic material and the relay 10 includes a separate ferromagnetic component (not shown) that surrounds the coil 18 and engages the top core 42 to provide the magnetic return.

The movable contact 22 is connected to the insulated rod 36 adjacent an end 46 of the insulated rod 36 that is opposite the end 38. The movable contact 22 may be connected to the insulated rod 36 in any suitable manner, configuration, and/or arrangement that enables it to function as described herein. In the exemplary embodiment, the movable contact 22 includes an opening 48 that receives the end 46 of the insulated rod 36 therein. The movable contact 22 is connected to the insulated rod 36 for movement therewith, or more specifically such that movement of the insulated rod 36 along the longitudinal axis 40 causes movement of the movable contact 22 along the longitudinal axis. However, the moveable contact 22 is also connected to the insulated rod 36 such that the movable contact 22 is slidably movable along, and with respect to, the insulated rod 36, as will be described below with regard to the operation of the relay 10. The opening 48 and the insulated rod 36 are sized to allow movement of the insulated rod 36 through the opening 48 and relative to the movable contact 22. Optionally, a bearing (not shown) and/or bushing (not shown) may be provided between the insulated rod 36 and the movable contact 22 to reduce friction and thereby facilitate movement of the insulated rod 36 through the opening 48.

To allow the movable contact 22 to move with, and also relative to, the insulated rod 36, a helical spring 50 surrounds a portion of the insulated rod 36 extending between the movable contact 22 and a flange, or ledge, 52 of the insulated rod 36. Operation of the spring 50 to allow the moveable contact 22 to move with, and also relative to, the insulated rod 36 is described below with regard to the operation of the relay 10. The spring 50 engages the movable contact 22 and the ledge 52 of the insulated rod 36. The spring 50 is insulated from the top core by a spacer 64, described below. A clip 58 or any other suitable fastener may be provided on the insulated rod 36 over the movable contact 22 to prevent the end 46 of the insulated rod 36 from moving back through the opening 48 of the movable contact 22. Although the spring 50 is described and illustrated herein as a helical spring, the spring 50 may be any other suitable spring or biasing mechanism that enables it to function as described herein.

The movable contact 22 may be fabricated from a non-ferromagnetic material such as, but not limited to, copper, but may include any suitable contact material such as, but not limited to, silver alloys, tungsten, and/or molybdenum. Although one movable contact 22 is illustrated, the relay may include two separate movable contacts, each for engaging a corresponding one of the stationary contact assemblies 20, which are connected to the insulated rod 36 and each other.

An inner housing 62 rests on the top core 42 and extends within the chamber 32 toward the open end 30 of the housing 12. The inner housing 62 may be fabricated from any suitable material(s), such as, but not limited to, a glass filled nylon material and/or other polymers such as, but not limited to, polyamide, polyester, PET, and/or polyolefin. The spacer 64 is positioned radially inward from the inner housing 62 and over a portion of the top core 42. To facilitate preventing arcs from shorting out to the top core, a dielectric membrane 66 may be positioned between the spacer 64 and the top core 42. The dielectric membrane 66 may be fabricated from any suitable material(s) that enable it to function as described herein, such as, but not limited to, Teflon.

Each stationary contact assembly 20 includes a lower stationary contact 68 and an upper terminal 70 connected to the lower stationary contact 68. The stationary contact assemblies 20 are held in a fixed spaced relationship with respect to the movable contact 22 by the ceramic header 24. The movable contact 22 is movable to engage and disengage the lower stationary contacts 68. Optionally, one or more permanent magnets (not shown) may be held in the chamber 32 of the housing 12 adjacent to the gaps between the movable contact 22 and the lower stationary contacts 68, when the movable contact 22 is disengaged, to facilitate reducing, and/or eliminating arcing between the movable contact 22 and the lower stationary contacts 68. One or more auxiliary contacts (not shown) may optionally be held in the chamber 32 of the housing 12. The auxiliary contact(s) may be configured to indicate a position of the movable contact 22 relative to the lower stationary contacts 68. The auxiliary contact(s) may have any suitable configuration and/or arrangement, and/or may include any suitable structure and/or means, that enable the auxiliary contact(s) to function as described herein. For example, the auxiliary contact(s) may include an actuating arm (not shown) connected to the movable contact 22, and a switch (not shown) operatively connected to the actuating arm.

The ceramic header 24 rests on and/or is connected to the inner housing 62. The housing 12 functions as a sealing container for the electromagnetic components of the relay 10, i.e., all of the electromagnetic components are enclosed within the chamber 32 of the housing 12, with the exception of the upper terminals 70 of the stationary contact assemblies 20. The housing 12 may therefore be fabricated from a material that is substantially impermeable to air, inert gases, and/or insulative gases. The ceramic header 24 seals the open end 30 of the housing 12 to thereby hermetically seal the chamber 32. To seal the ceramic header 24 to the housing 12, the ceramic header 24 is circumferentially welded to the housing 12 at the open end 30 thereof. The ceramic header 24 may be welded to the housing 12 in any suitable manner, configuration, and/or arrangement, and/or using any suitable welding process(es) and/or material(s), that enables the ceramic header 24 to hermetically seal the open end 30 of the housing 12. For example, in the exemplary embodiment, an outer edge 74 of the ceramic header 24, along the entire circumference of the ceramic header 24, is connected, such as, but not limited to, brazed, to a metal seal 78 that is welded to a rim 76 of the housing 12 along the entire circumference of the rim 76. In the exemplary embodiment, the metal seal 78 includes a base 77 that is connected to the ceramic header 24, and a lip 79 that extends from the base 77 and is welded to the rim 76 of the housing 12. Optionally, the base 77 is received within the open end 30 of the housing 12 and the lip 79 extends over the rim 76 of the housing 12. In the exemplary embodiment, the ceramic header 24 is received within the open end 30 of the housing 12 such that the ceramic header 24 is positioned within the chamber 32 of the housing. Alternatively, one or more portions or all of the ceramic header 24 is not positioned within the chamber 32 of the housing 12. For example, the ceramic header 24 may be positioned over the rim 76 of the housing 12. In such alternative embodiments, a portion of the lower stationary contacts 68 may not be positioned within the chamber 32 of the housing 12.

The ceramic header 24 may be fabricated from any suitable ceramic material(s), in addition to optionally including other non-ceramic material(s), that enable the ceramic header 24 to function as described herein. The metal seal 78 may be fabricated from any suitable metal(s), in addition to optionally including other non-metallic material(s), that enable the seal 78 to function as describe herein.

The ceramic header 24 may include an evacuation port 80 coupled in fluid communication with the chamber 32 of the housing 12 for removing gas from the chamber 32 of the housing 12 and/or introducing gas into the chamber 32. Specifically, once the chamber 32 of the housing 12 has been hermetically sealed, the chamber 32 may be evacuated to a partial or complete vacuum, such as, but not limited to $10^{-5}$ Torr or less, using the evacuation port 80. Alternatively, the evacuation port 80 may be used to introduce any suitable inert and/or insulative gas(es) into the chamber 32, such as, but not limited to Hydrogen, Nitrogen, and/or sulphur hexafluoride, once the chamber 32 has been hermetically sealed. The chamber 32 may be filled with gas to any suitable pressure, such as, but not limited to, between about 5 to about 200 psi. Evacuating the chamber 32 to a partial or complete vacuum, or introducing an inert and/or insulative gas into the chamber 32 may facilitate suppressing arc formation within the chamber 32. Once the chamber 32 has been evacuated or filled, the evacuation port 80 may be pinched or capped to maintain the hermetic seal.

Figure 3:
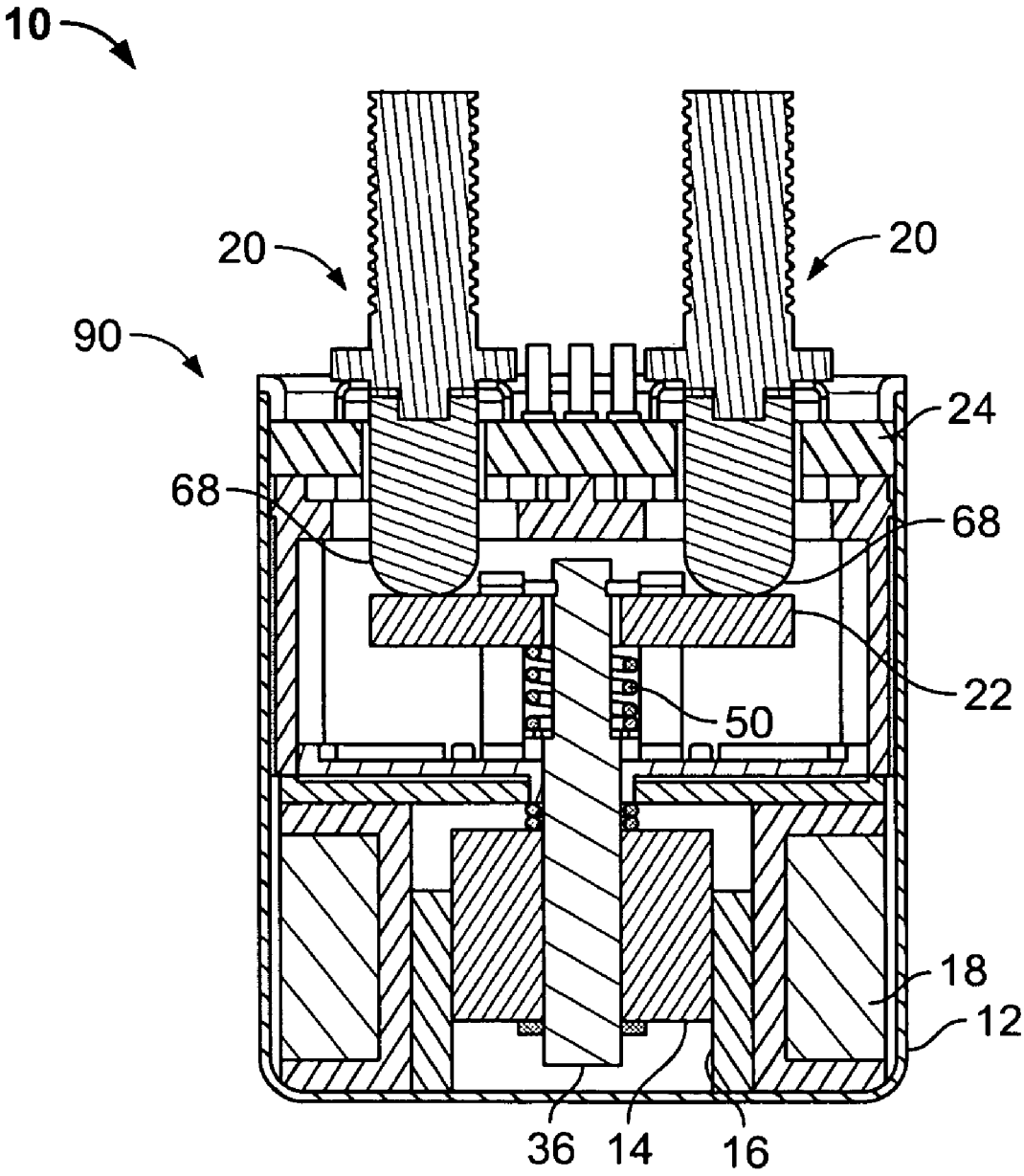
FIG. 3 is a cross-sectional view of the relay shown in FIG. 1 in a closed position.

In operation, the relay 10 is biased to an open position 82, shown in FIG. 1, wherein the movable contact 22 does not engage the lower stationary contacts 68 and wherein the armature is below the centroid of the coil 18. Specifically, a helical spring 84 surrounds a portion of the insulated rod 36 extending between the top core 42 and the armature 14. The spring 84 engages the armature 14 and the top core 42. When the coil 18 is energized, the insulated rod 36 and the armature 14 move along the longitudinal axis 40 toward the open end of the housing 12. The movable contact 22 moves along with the insulated rod 36 until the movable contact 22 engages the lower stationary contacts 68 thereby making an electrical connection therebetween. As the insulated rod 36 continues to move along the longitudinal axis 40 toward the open end of the housing 12, the movable contact 22 is restrained by the lower stationary contacts 68 and therefore slidably moves along, and with respect to, the insulated rod 36. As the movable contact 22 slidably moves along, and with respect to, the insulated rod 36, the spring 50 is compressed and thereby exerts a force on the movable contact 22 that facilitates maintaining the engagement between the movable contact 22 and the lower stationary contacts 68. FIG. 3 illustrates a closed position 90 wherein the movable contact 22 is engaged with the lower stationary contacts 68 and the spring 50 is compressed.

Although the spring 84 is described and illustrated herein as a helical spring, the spring 84 may be any other suitable spring or biasing mechanism that enables it to function as described herein. Moreover, although the relay 10 is described and illustrated herein as including pair of stationary contact assemblies 20 and one or more movable contacts 22 that engages the stationary contact assemblies 20 to make an electrical connection therebetween, the relay 10 may alternatively includes one or more other pairs of stationary contact assemblies (not shown) that are each engaged by one or more other movable contacts (not shown) to make an electrical connection between the stationary contact assemblies of the other pair(s). Such other movable contacts may be connected to the insulated rod 36 or may be driven by a separate coil, armature, and/or insulated rod assembly (not shown) contained within the chamber 32 of the housing 12. Although the housing 12 is illustrated as generally cylindrical, the housing 12 may have any suitable shape(s) enabling the housing 12 to function as described herein.

Figure 4:
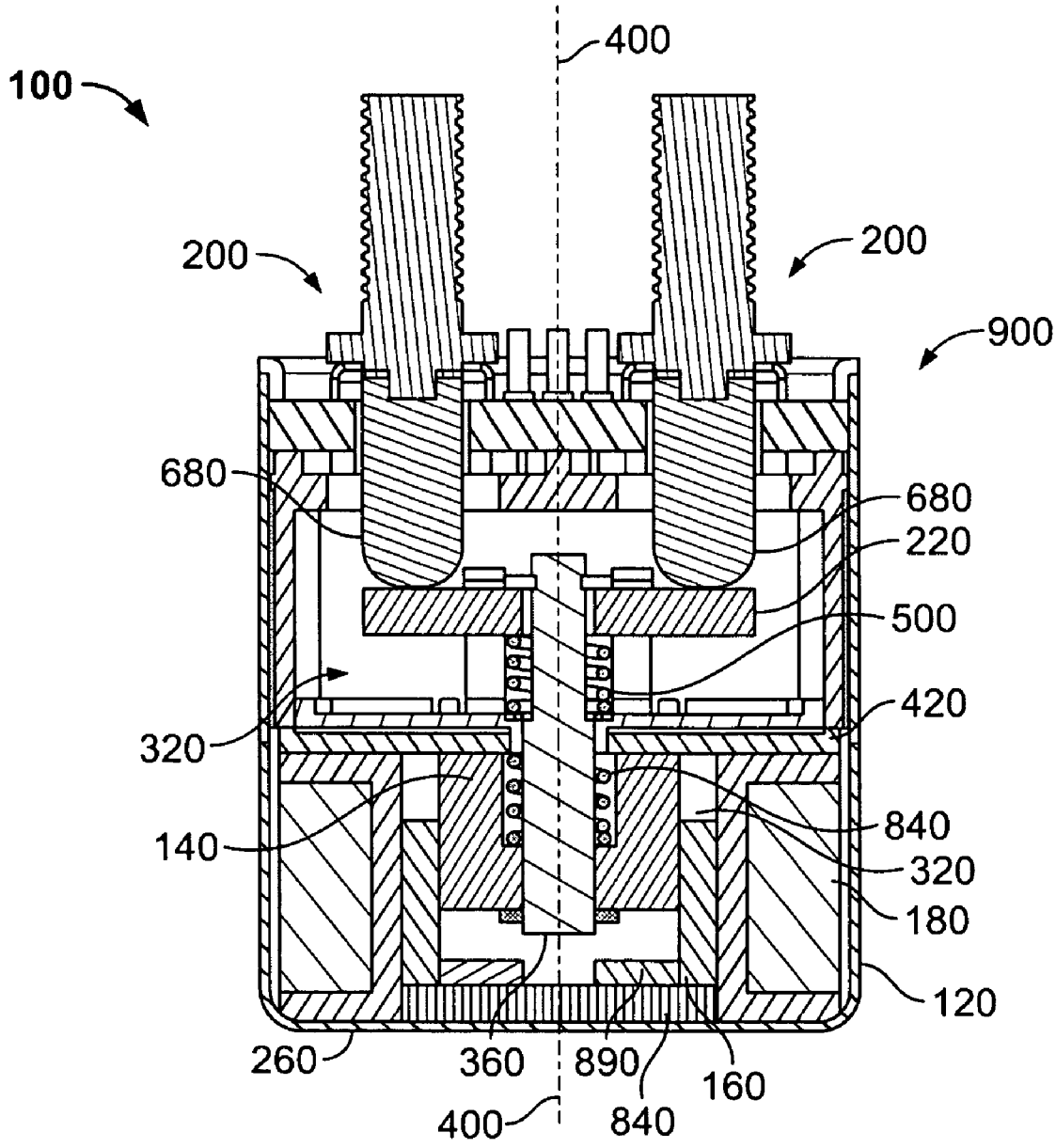
FIG. 4 is a cross-sectional view of an electromechanical relay formed in accordance with another embodiment of the present invention.

FIG. 4 is a cross-sectional view of an electromechanical relay 100 formed in accordance with another embodiment of the present invention. Similar to the relay 10 (shown in FIGS. 1-3), the relay 100 includes a housing 120 having a bottom wall 260 and a chamber 320 containing an armature 140, an inner core 160, a coil 180, an insulated rod 360, a top core 420, a portion of a pair of stationary contact assemblies 200, and one or more movable contacts 220. However, rather than being biased to an open position (not shown) like the relay 10, the relay 100 is biased to a closed position 900 wherein the movable contact(s) 220 engages a lower stationary contact 680 of each of the pair of stationary contact assemblies 200. The relay 100 includes a permanent magnet 850 positioned between the bottom wall 260 of the housing 120 and the inner core 160. In the exemplary embodiment, a portion of the permanent magnet 850 extends between the inner core 160 and the bottom wall 260 of the housing 120. However, the permanent magnet 850 may have any suitable position, orientation, and/or location within the chamber 320 that enables the permanent magnet 850 to function as described herein. Optionally, a spacer 890 may be positioned between the permanent magnet 850 and the armature 140 to limit the armature 140 to a maximum open position. A helical spring 840 is positioned between the top core 420 and the armature 140. The permanent magnet 850 may include any suitable material(s) that enable the permanent magnet 850 to function as described herein, such as, but not limited to, samarium-cobalt, aluminum-nickel-cobalt, and/or neodymium-iron-boron.

In operation, the relay 100 is biased to the closed position 900 due to the magneto motive force supplied by the permanent magnet 850 which overcomes the spring force of the spring 840 and a spring 500. When the coil 180 is energized in the proper sense to oppose the flux of the permanent magnet 850, the insulated rod 360 and the armature 140 move along a longitudinal axis 400 of the relay 100 toward the spacer 890 and the bottom wall 260 of the housing 120 due to the combined forces of the springs 840 and 500 causing the movable contact(s) 220 to disengage from the lower stationary contacts 680.

Figure 5:
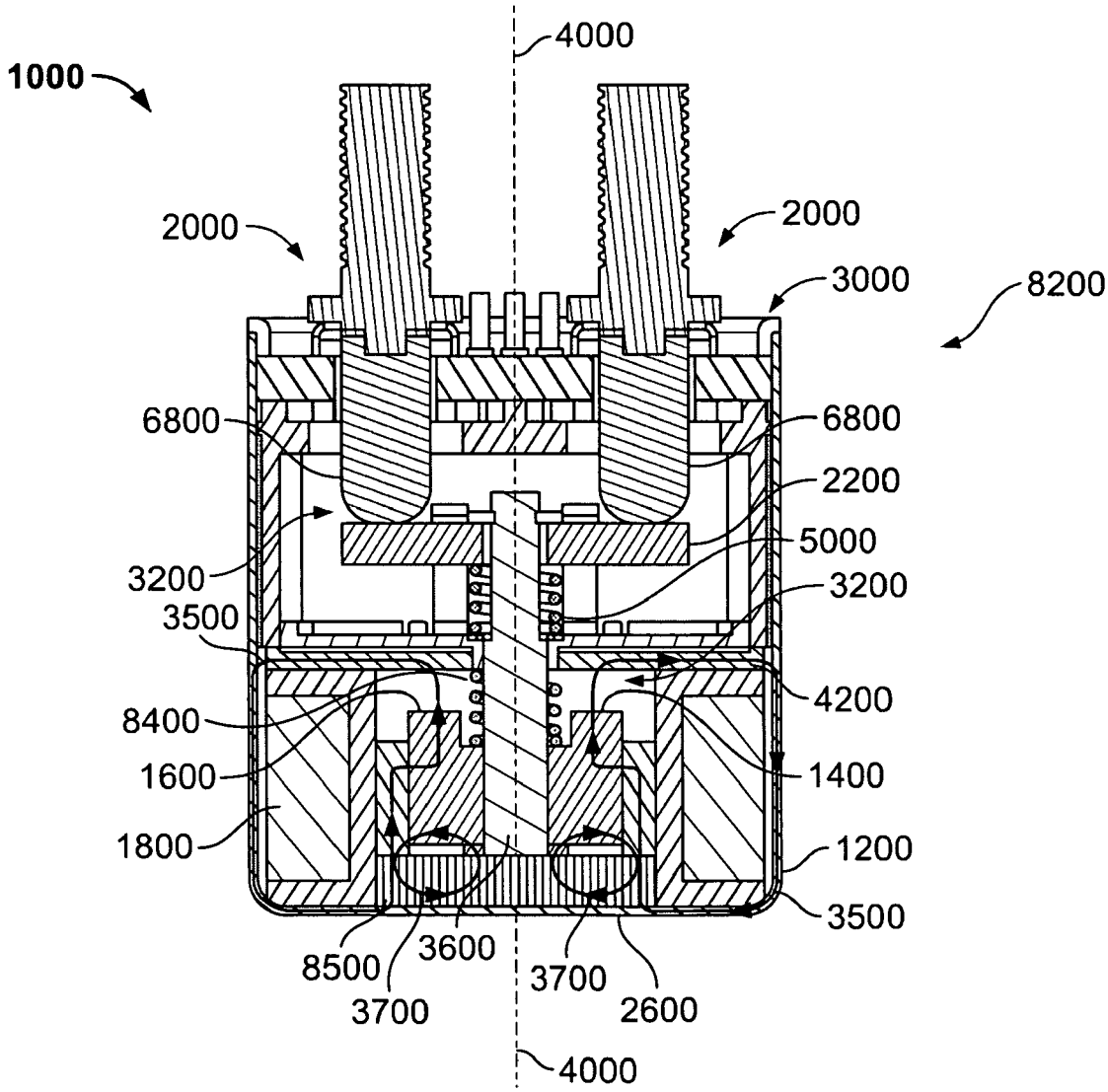
FIG. 5 is a cross-sectional view of an electromechanical relay formed in accordance with another embodiment of the present invention.

FIG. 5 is a cross-sectional view of an electromechanical relay 1000 formed in accordance with another embodiment of the present invention. Similar to the relay 10 (shown in FIGS. 1-3), the relay 1000 includes a housing 1200 having a bottom wall 2600 and a chamber 3200 containing an armature 1400, an inner core 1600, a coil 1800, an insulated rod 3600, a top core 4200, a portion of a pair of stationary contact assemblies 2000, and one or more movable contacts 2200. The relay 1000 is shown latched in an open position 8200 wherein the movable contact(s) 2200 does not engage a lower stationary contact 6800 of each of the pair of stationary contact assemblies 2000. The armature 1400 and the movable contact(s) 2200 are magnetically latchable in the open position 8200 and a closed position (not shown) by a permanent magnet 8500 positioned between armature 1400 and the bottom wall 2600 of the housing 120. In the exemplary embodiment, a portion of the permanent magnet 8500 extends between the inner core 1600 and the bottom wall 2600 of the housing 1200. However, the permanent magnet 8500 may have any suitable position, orientation, and/or location within a primary magnetic circuit 3500 of the relay 1000 that enables the permanent magnet 8500 to magnetically latch the movable contact(s) 2200 in the open position 8200 and the closed position. The permanent magnet 8500 may include any suitable material(s) that enable the permanent magnet 8500 to function as described herein, such as, but not limited to, samarium-cobalt, aluminum-nickel-cobalt, and/or neodymium-iron-boron.

In operation, the relay 1000 is latched in the open position 8200 by the attraction of the armature 1400 to the permanent magnet 8500 through a secondary magnetic circuit 3700 and the combined forces of the springs 8400 and 5000. When the coil 1800 is energized in the proper sense, the movable contact(s) 2200 is unlatched from the open position 8200 and the insulated rod 3600 and the armature 1400 move along a longitudinal axis 4000 of the relay 1000 toward an open end 3000 of the housing 1200 to the closed position wherein the movable contact(s) 2200 engages the lower stationary contacts 6800. In the closed position, the coil 1800 can then be de-energized and the movable contact 2200 will remain latched in the closed position due to the force supplied by the flux in the primary magnetic circuit 3500 under the influence of the permanent magnet 8500. The movable contact 2200 can then be unlatched from the closed position and moved to the open position 8200 by the application of current of the opposing sense in the coil 1800.

The embodiments described herein provide a hermetically sealed relay that may contain a higher vacuum, have a seal that is less porous to some inert and/or insulating gases, and/or be able to maintain such a seal at higher temperatures than at least some known hermetically sealed relays.

While the invention has been described in terms of various specific embodiments, those skilled in the art will recognize that the invention may be practiced with modification within the spirit and scope of the claims.

What is claimed is:

1. An electromechanical relay comprising:

an armature;

an inner core at least partially surrounding at least a portion of the armature, the armature being slidably movable relative to the inner core;

a coil at least partially surrounding at least a portion of the inner core;

a stationary contact held in a ceramic header, the ceramic header comprising a chamber side and an opposite rim side;

a movable contact connected to the armature via a shaft, the movable contact being movable between an open position wherein the movable contact does not engage the stationary contact and a closed position wherein the movable contact engages the stationary contact;

a housing having an open end and a chamber, the housing comprising a rim at the open end of the housing, the chamber containing the armature, the inner core, the coil, the movable contact, and at least a portion of the stationary contact, the chamber side of the ceramic header facing into the chamber of the housing, the rim side of the ceramic header facing out of the chamber, wherein the ceramic header is circumferentially welded to the housing adjacent the open end such that the chamber of the housing is hermetically sealed; and a metal seal, the ceramic header being circumferentially welded to the housing the metal seal, wherein the metal seal comprises a base and a lip extending from the base, the base of the metal seal being received within the open end of the housing, wherein the metal seal extends outwardly from the rim side of the ceramic header such that the lip extends radially outward over the rim of the housing.

2. The relay according to claim 1, wherein the housing comprises a ferromagnetic material.

3. The relay according to claim 1, wherein the housing forms an outer core surrounding the coil.

4. The relay according to claim 1, further comprising a port coupled in fluid communication with the chamber of the housing for at least one of removing gas from the chamber and introducing gas into the chamber.

5. The relay according to claim 1, further comprising a ferromagnetic top core positioned over a top of the coil such that the coil is sandwiched between the top core and a bottom of the housing.

6. The relay according to claim 1, wherein the ceramic header is at least partially received within the open end of the housing.

7. The relay according to claim 1, wherein the movable contact is biased to the open position by a spring engaging the movable contact, the movable contact being movable to the closed position by application of power to the coil.

8. The relay according to claim 1, wherein the metal seal is welded to the housing.

9. The relay according to claim 1, wherein the base of the metal seal is circular.

10. The relay according to claim 1, wherein the ceramic header is circumferentially welded to the rim of the housing using the metal seal.

11. The relay according to claim 1, wherein the rim side of the ceramic header is connected to the metal seal and the metal seal is welded to the housing.

* * * * *